US005353701A

United States Patent [19]

Casagrande

[11] Patent Number: 5,353,701

[45] Date of Patent: Oct. 11, 1994

[54] STENCIL APPARATUS

[76] Inventor: Charles L. Casagrande, 423 S. Elmwood, Aurora, Ill. 60506

[21] Appl. No.: 102,700

[22] Filed: Aug. 5, 1993

Related U.S. Application Data

[63] Continuation of Ser. No. 844,144, Mar. 2, 1992, abandoned, which is a continuation-in-part of Ser. No. 545,473, Jun. 27, 1990, abandoned.

[51] Int. Cl.[5] ..... B41N 1/24

[52] U.S. Cl. ..... 101/127; 101/127.1; 101/128.1; 101/128.4; 400/544

[58] Field of Search ..... 101/127, 127.1, 128, 101/128.1, 128.4, 482; 400/622, 544, 522

[56] References Cited

U.S. PATENT DOCUMENTS

| | | | |
|---|---|---|---|
| 3,280,732 | 10/1966 | Mooney et al. | 101/128.21 X |
| 3,457,856 | 7/1969 | Rydberg et al. | 101/128.21 |
| 3,926,113 | 12/1975 | Steidinger | 101/128.1 |
| 4,022,723 | 5/1977 | Hokama et al. | 525/98 |
| 4,664,031 | 5/1987 | McKillip | 101/127.1 |

OTHER PUBLICATIONS

Product Literature of Technicote relating to Magic Film TM Product.

*Primary Examiner*—Edgar S. Burr
*Assistant Examiner*—John S. Hilten
*Attorney, Agent, or Firm*—Olson & Hierl, Ltd.

[57] ABSTRACT

A stencil apparatus which can be releasably secured to an upper surface of a substrate. The stencil apparatus comprises a stencil material which is deformable to accept impression of indicia and also enables the reproduction of the impressed indicia on another surface. The stencil apparatus further can include a substantially continuous frame which defines an opening and is attached to a marginal portion of the stencil material. The opening is large enough to permit the stencil material to contact the substrate in an unobstructed manner for transfer of the impressed indicia onto the substrate. The present invention is cleanly and releasably secured to the substrate. The apparatus attaches such that objectionable residues do not remain on the substrate and the stencil apparatus after the stencil apparatus is released therefrom. The apparatus is designed to be producible in a roll which is suitable for use on label affixing equipment.

38 Claims, 6 Drawing Sheets

STENCIL APPARATUS

RELATED APPLICATION

This application is a continuation of Ser. No. 844,144 which was filed on Mar. 2, 1992, now abandoned, which was a continuation-in-part of Ser. No. 545,473 filed Jun. 27, 1990, now abandoned.

TECHNICAL FIELD

The present invention relates to stencils in general and specifically to a stencil apparatus which is cleanly and releasably secured to a substrate, a method of manufacturing the stencil apparatus and a method of affixing the stencil apparatus to the substrate.

BACKGROUND OF THE INVENTION

Stencils for use in conjunction with a substrate such as a business form have been used for many years. It is a huge market as approximately 80% of industry uses stencils.

The stencil material generally consists of a thin tissue material with a top and a bottom surface. A carbon layer is often incorporated into the bottom surface of the stencil. The carbon layer allows an impression of indicia on the top surface of the stencil to be transferred to a substrate. The transfer allows the impressed indicia to be readable on the substrate as well as the stencil itself.

The stencil material with the impressed indicia is removed from the substrate and taken to a second surface. The impressed indicia are reproduced on this second surface by applying a fluid medium, usually an ink, to the top surface of the stencil material. The fluid medium passes through the stencil material by way of the impressed indicia and thereby reproduces the impressed indicia on the second surface.

For example, the original substrate is often a document such as a bill of lading or an invoice while the second surface is a package being shipped which corresponds to such a document. Such use of stencil materials reduces the chance of a typographical error in transcribing an address as well as being a real time-saver by eliminating the need to write the shipping address on a label or directly on each separate package. In a multi-package shipment, the errors are reduced even more and the material and time saved even greater as a single stencil can be used for multiple packages.

Two somewhat conflicting concerns have bedeviled the stencil industry. On one hand, the shipping floor wants a stencil that is tough enough to take rough handling. Conversely, the office wants a product which can be attached and removed from a form quickly and easily without jamming the printing equipment.

Originally, in the office the stencil material was directly laid on the substrate, usually some type of business form. Sometimes adhesive tape was used to hold the material in place. This proved unsatisfactory as the thin stencil material tended to fold over and tear when placed in typewriters or printers. In addition, this method was labor-intensive as well as being time consuming.

An edge made of heavier material which attaches to the substrate was added to solve some of these problems. The stencil material was attached to the edge thus forming a tape top stencil. The edge was attached to the substrate and provided support for the stencil material.

Perforations between the edge and the stencil material were added to simplify their separation.

While an improvement, the edge did not totally solve the problem of tearing and folding. The thin stencil material was still unsupported along three sides. Therefore, often a releasable glue was applied to attach the free sides to prevent jamming. As a consequence, applying tape top stencils to a form is still a slow, tedious process.

In addition, little if any gains were seen in productivity in the office because the glue could not coat to the edges of the stencil. As a result, printer jamming still was a common occurrence. Handling the separated stencil, for example, by warehousemen as noted above, was still a considerable problem. Also, the edge was generally left behind on the substrate which added its own set of problems. The edge made each substrate thicker which resulted in using up valuable storage space.

One development which aided the shipping floor handling concerns was the framed stencil in which a frame of heavier construction completely covers the periphery of the stencil material. Once detached from the substrate, the frame prevented the folding and tearing of the stencil material. The stencil material was held rigidly, thus making the application of a fluid medium or reading the impressed indicia easier.

However, many drawbacks still exist with the framed stencil as described. For example, if the frame stencil is not adhered to the substrate completely, the stiff frame will separate from the substrate when traversing rollers in a printer which acts to jam the printer. Another drawback is the limitations imposed by the equipment needed to affix the framed stencil to the substrate.

Both frame stencils and tape top stencils are generally adhered to substrate by the application of a releasable adhesive between the frame and the form. Presently, this requires the addition of a releasable glue between the form and the stencil which adds considerably to the cost and time required to apply the stencil to the substrate. The glue application machinery is very expensive and slow. Quite often, users will apply the glue manually to avoid the expense of such a machine.

In addition, once the stencil is removed from the substrate, a glue residue is left on both the stencil and the substrate. Carbon will adhere to the glue and produce smears on the form. The adhered carbon is aesthetically displeasing at best and can render the form unreadable. The substrates can stick together if stacked and will pick up dirt and dust which adhere to the glue residue. Also, when the stencil is placed on the second surface, such glue residue may cause the stencil to adhere to the second surface.

Further, the amount of glue applied is a critical factor which is difficult to control. If the amount of glue is excessive, the stencil may not release from the substrate. If the amount of glue is inadequate, the stencil may release from the substrate prematurely thus jamming the printer.

In addition to the problem of controlling the amount of glue applied to the stencil, the location of the glue is also important. The glue can not extend beyond the stencil in order to prevent stacked substrates from adhering to one another. As a result, the glue cannot totally seal the edges of the stencil which results in exposed dry edges. Such exposed dry edges are very susceptible to jamming in machines such as printers or typewriters.

The aforementioned problems have made the affixation of stencils to substrates a very slow, expensive and complex process with severe limitations. For example, the benefits of framed stencils are often negated by problems in affixing such stencils to forms and therefore the majority of stencils in use today are the tape top stencils described earlier.

The industry has sought to correct these problems for a number of years. One desired approach has been to find a method of affixing stencils to forms which utilizes label affixing equipment. Label affixing equipment is easy to operate, far less expensive, much faster and far more accurate than a conventional glue machine. However, to utilize such equipment, the stencils must be produced in a format on a roll. In short, label affixing equipment requires a stencil apparatus which is specifically designed for use on such equipment.

Accordingly, what is needed is a stencil apparatus which is releasably attached to a substrate but avoids leaving any objectionable residues on the substrate once the framed stencil is removed. Such a stencil apparatus should also retain the considerable advantages entailed by the use of framed stencils. The apparatus should also allow for the easy gripping and removal of the stencil from the substrate but also alleviate the problem of printer jams. Further, the apparatus must be producible in a roll which is suitable for use on label affixing equipment. The present invention meets these desires.

SUMMARY OF THE INVENTION

The present invention is a stencil apparatus which can be releasably secured to an upper surface of a substrate. The stencil apparatus comprises a stencil material which is deformable to accept impression of indicia. The stencil material also enables the reproduction of the impressed indicia on another surface by the application of a fluid medium so that the fluid medium can pass through the impressed indicia to reproduce the impressed indicia on the other surface.

One embodiment of the present invention further includes a substantially continuous frame which has an upper surface and a lower surface and further defines an opening. The opening is large enough to permit the bottom surface of the stencil material to contact the substrate in an unobstructed manner for transfer of the impressed indicia onto the substrate. The frame is attached to a marginal portion of the stencil material by framed stencil attachment means.

The present invention also includes substrate attachment means mounted on the bottom surface of the frame. The substrate attachment means cleanly and releasably secures the stencil apparatus on the substrate. The lower surface of the stencil material is in the desired location on the substrate. The substrate attachment means is such that objectionable residues do not remain on the substrate and the frame after the frame is released therefrom. An example of an objectionable residue which is avoided is an adhesive which remains tacky after the frame is removed.

The present apparatus is designed to be producible in a roll which is suitable for use on label affixing equipment thus allowing quick and accurate adherence to a substrate. The stencil apparatus disclosed herein does not utilize glue for adherence to a substrate. In addition, the edges of the present invention can be sealed to prevent jamming of printers.

BRIEF DESCRIPTION OF THE DRAWINGS

In the drawings, which comprise a portion of this disclosure:

FIG. 12 is a side view of a preferred process for adhering the preferred framed stencil apparatuses to a

DETAILED DESCRIPTION OF THE PREFERRED EMBODIMENT

Figure 1:
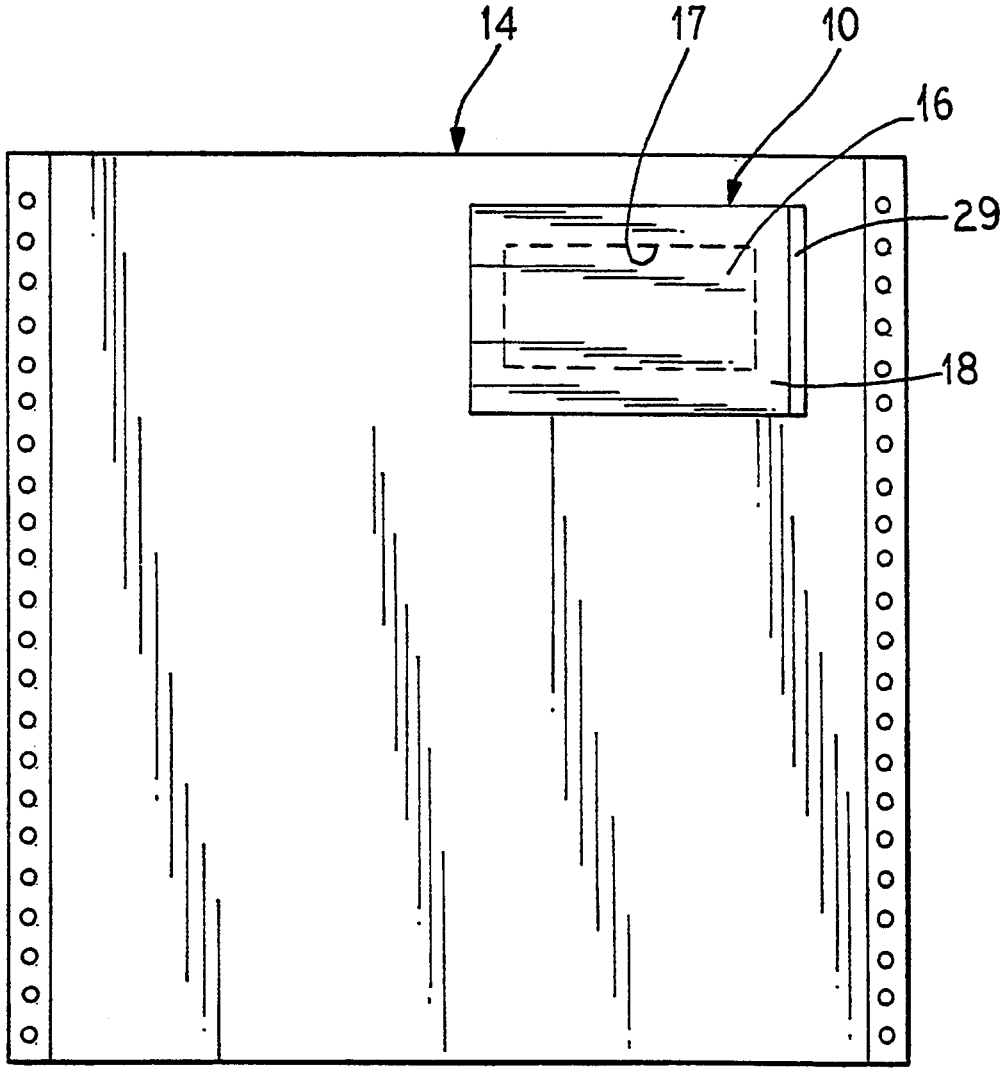
FIG. 1 is a top view of a framed stencil attached to a form.

While this invention is susceptible of embodiment in many different forms, there is shown in the drawings and will herein be described in detail, one specific embodiment as well as several alternative embodiments, with the understanding that the present disclosure is to be considered as an exemplification of the principles of the invention and is not intended to limit the invention to the embodiment described.

FIG. 1 shows a top view of a stencil apparatus 10 of its present embodiment. The stencil apparatus 10 is shown attached to a substrate, in this case, a form 14. The stencil apparatus 10 can be seen to have a stencil material 16 and a frame 18.

The stencil material 16 has a top surface and a bottom surface. The stencil material 16 deforms to accept the impression of indicia. The impressed indicia can be reproduced on a second surface by applying a fluid medium to the top surface. The fluid medium passes through the impressed indicia to the bottom surface thereby reproducing the impressed indicia on the second surface.

The frame 18 is substantially continuous and defines an opening 17. The opening 17 is large enough to allow the bottom surface of the stencil material 16 to contact the form 14. This permits the transfer of impressed indicia to the form 14 and the other surface as desired. The frame 18 is attached to a marginal portion of the periphery by framed stencil attachment means 28, preferably an adhesive, as best explained in the discussion below and shown in FIGS. 2 and 3.

Figure 2:
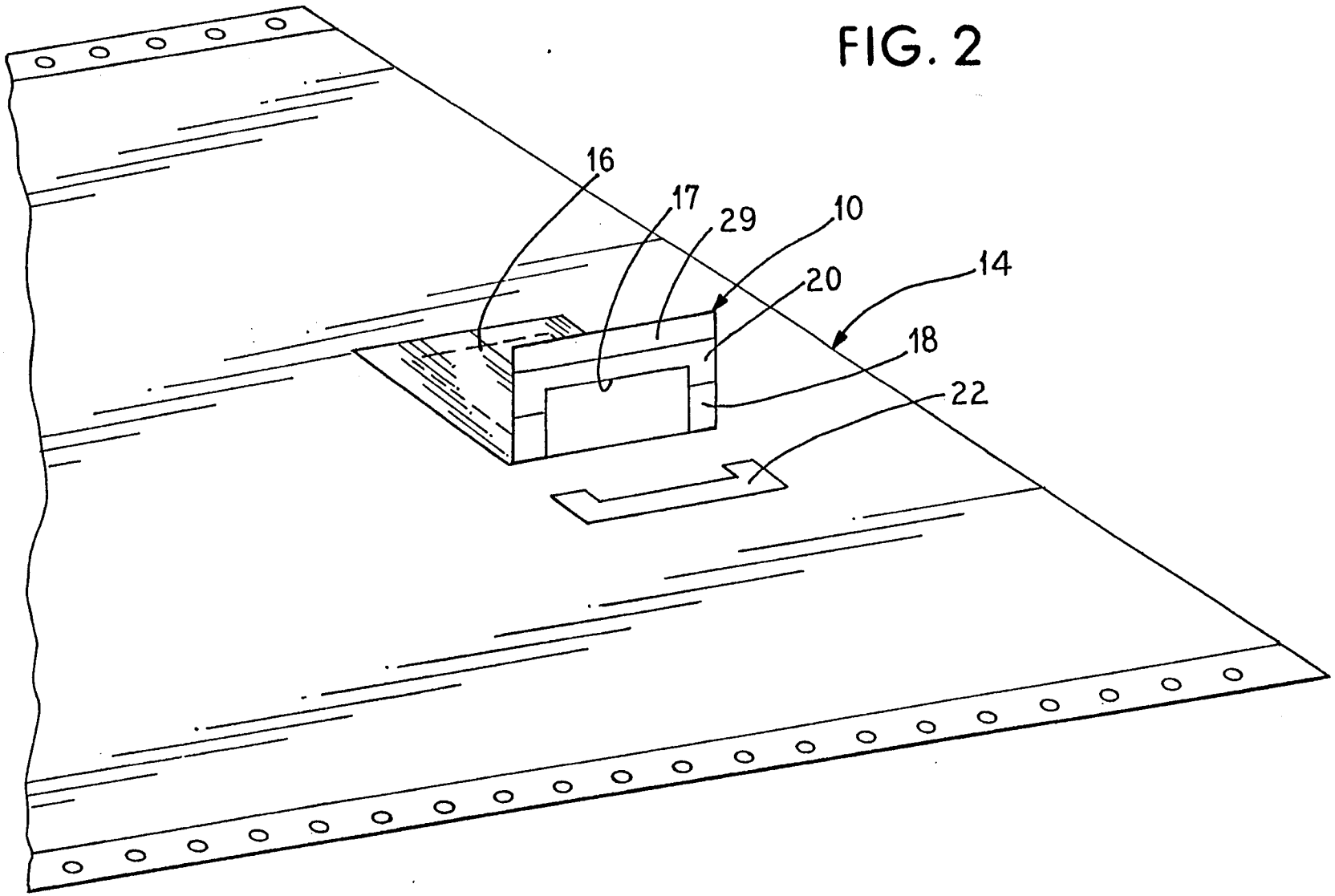
FIG. 2 is a perspective view of the framed stencil partially removed from the form.

FIG. 2 is a perspective view of the stencil apparatus 10 partially removed from the form 14. The stencil material 16 and the frame 18 are again visible. A clear view of substrate attachment means 19 is provided. The substrate attachment means 19 secures the stencil apparatus 10 to the form 14. The substrate attachment means 19 allows the frame 18 and the stencil material 16 to be cleanly released from the form 14, leaving no objectionable residues.

The substrate attachment means 19 preferably comprises a first film 20, a second film 22 and a chemical bonding 23. The first film 20 remains with the frame 18 and the stencil material 16 when the stencil apparatus 10 is separated. The first film 20 is preferably a plastic film such as a cast vinyl or acrylic. The first film 20 is preferably adhered to the frame 18 by an adhesive.

The second film 22 remains on the form 14 after the separation. The second film 22 adheres to the form 14 preferably through an adhesive. The chemical bonding 23 is the layer which splits when the stencil apparatus 10 is separated, as best explained in the discussion below and shown in FIG. 3.

In the embodiment depicted in FIG. 2, the second film 22 does not extend over the entire rectangular frame 18. Instead, it is formed in two U-shaped portions positioned on opposing sides of the frame 18. In an alternate embodiment, second film 22 does cover the entire frame 18. The alternative embodiment is preferred as it leaves no exposed dry edges to catch and jam on label affixing equipment, printers, typewriters and the like.

The first film 20 and the second film 22 have no objectionable residue after separation, are not tacky and are dry to the touch. The first film 20 and the second film 22 do not adhere to paper or skin. Additionally, the first film 20 will not adhere to the second surface. The first film 20 and the second film 22 will not discolor by the adhesion of dirt or dust.

Preferably, the second film 22 is a one half to one mil film such as MYLAR® polyester made by DuPont. Other suitable materials for either the first film 20 or the second film 22 will be apparent to those skilled in the art. As one alternative, it is possible to use paper as the first film 20 and the second film 22.

Figure 3:
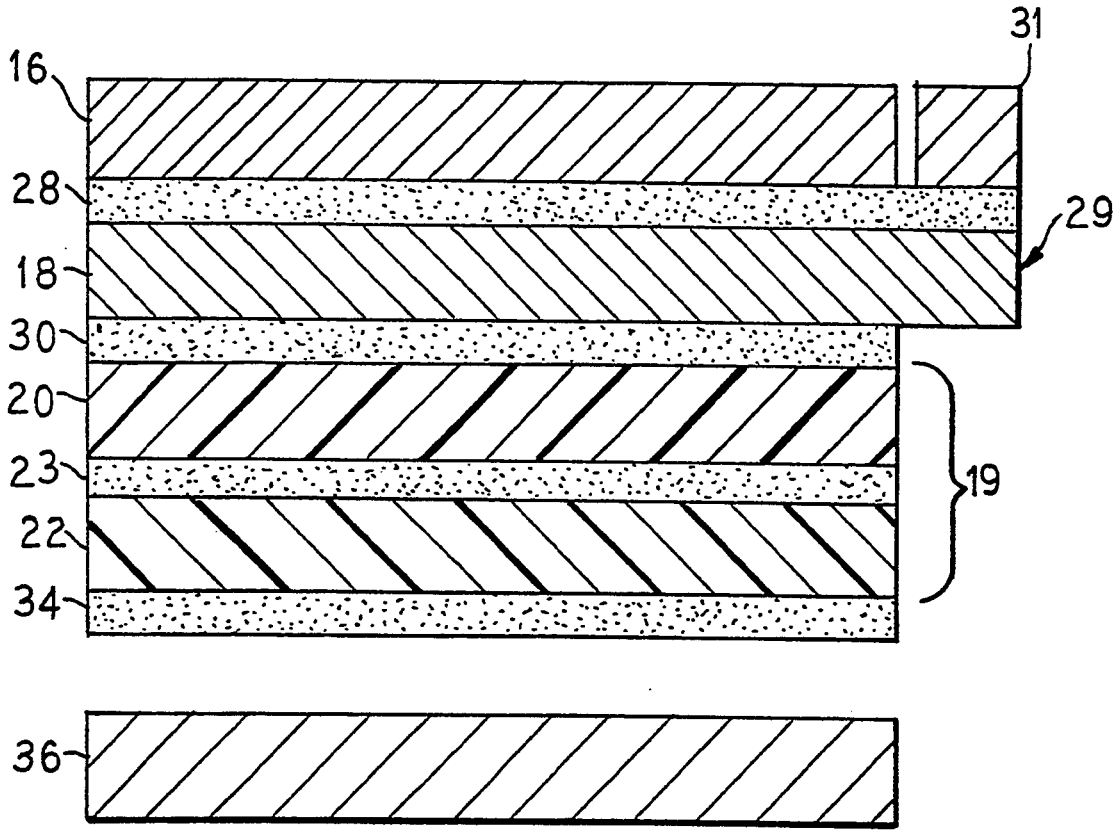
FIG. 3 is a side view of the framed stencil showing the various layers which make up the apparatus.

FIG. 3 is a side view of the stencil apparatus 10 along the horizontal direction. FIG. 3 shows the individual layers which make up a preferred embodiment of the present invention.

The top layer is the stencil material 16. Preferably, this comprises a stencil tissue with a carbon layer on the bottom surface. Alternatively, the stencil tissue can be made with the carbon layer integrated with the stencil tissue. The carbon layer is the preferred means for transferring the impression of indicia to the form 14.

The stencil material 16 is deformable to accept the impressed indicia. The carbon layer transfers the impressed indicia to whatever surface is directly beneath the stencil material 16. This can be the form 14 but other surfaces are possible as one skilled in the art will readily appreciate.

The frame 18 is shown as the third layer. The frame 18 material is preferably a 60#or 80#offset paper. Other suitable materials will be readily apparent to those skilled in the art. Interposed between the frame 18 and the stencil material 16 is framed stencil attachment means 28. The framed stencil attachment means 28 is preferably an acrylic adhesive.

In the preferred embodiment, the order of the frame 18 and the stencil material 16 is as shown. However, as an alternative embodiment, the positions of the frame 18 and the stencil material 16 could be reversed.

In the preferred embodiment, the offset paper and the frame stencil attachment means 28 are purchased as a unit from the Brown-Bridge Division of Kimberly-Clark. Brown-Bridge's B85 adhesive is specified as the adhesive for use as the framed stencil attachment means 28. The purchased unit is supplied in a roll which further includes a release liner covering the adhesive.

In an alternative embodiment, a tab 29 is mounted to frame 18 to provide an easy grasping point to manually separate the layers of the stencil apparatus 10. The tab 29 is particularly useful in an embodiment where the first film 20 and the second film 22 cover the frame 18 completely. As the frame 18 has no exposed edges in this embodiment, it can be difficult to grasp and remove the apparatus from the substrate without the presence of the tab 29.

In one embodiment, the tab 29 is made by manufacturing frame 18 larger than stencil material 16. The excess portion of form 18 extends beyond the stencil material 16 forming tab 29. If desired, a label 31 may be on the same side as tab 29 with an appropriate message such as "Peel Here."

The frame 18 and the stencil material 16, after the stencil apparatus 10 is separated, are placed on a desired location such as a shipping carton. A fluid medium, usually an ink, is placed on the top surface 26 of stencil material 16. The transfer of impressed indicia described herein is generally done by stencil mechanisms (not shown) in which the framed stencil is placed. The mechanisms usually have a refillable ink supply and are hand operated. The impressed indicia are thereby transferred to the desired location by bleeding through the stencil material 16. Such stencil mechanisms are old in the art and will not be further discussed here.

The first film 20 is shown as the fifth layer. Interposed between the first film 20 and the frame 18 is, preferably, a first adhesive 30. The first adhesive 30 prevents the frame 18 from separating from the first film 20.

The second film 22 is shown as the seventh layer. A second adhesive 34 adheres the second film 22 to the form 14 where it remains after the stencil apparatus 10 is removed. Interposed between the first film 20 and second film 22 is the chemical bonding 23.

The term chemical bonding 23 as herein used covers a variety of adhesive techniques. In a simple form, chemical bonding 23 can be the forces which hold two films together when they are laminated together under heat and pressure. Alternatively, these forces are those which arise when the second film 22 is cast on the first film 20. Depending on the films utilized, the operable forces can be static electricity, hydrogen bonding, molecular bonds between the molecules making up the two films, a mechanical bonding or a combination of these forces.

Alternatively, thin layers of adhesives such as AWD-8900 available from Arcar Graphics, Inc. of West Chicago, Ill. can be used. The key to having either type of chemical bonding 23 suitable for the present invention is the ability to leave the first film 20 and the second film 22 without objectionable residues, tack-free and dry to the touch, when the first film 20 and the second film 22 are separated.

The present preferred embodiment utilizes MAGIC FILM® made by Technicote of Miamisburg, Ohio, who supplies the first film 20, the second film 22, the chemical bonding 23, the first adhesive layer 30 and second adhesive layer 34.

The MAGIC FILM® construction found in the preferred embodiment of the present invention is a custom product designed by and made specifically for applicant. The usual MAGIC FILM® construction comprises the first film 20 which is chemically bonded to the second film 22. An adhesive is applied to the second film, the adhesive then being covered by a silicone release paper or film. This adhesive corresponds to the second adhesive 34 of the preferred embodiment described above.

The custom designed MAGIC FILM® adds another adhesive layer to the exposed side of the first film 20. This adhesive layer corresponds to the first adhesive 30 of the preferred embodiment described above. In the preferred embodiment the first and second adhesives 30 and 34 are an acrylic emulsions such as TP 110 or TS 523 available from Technicote.

Figure 6:
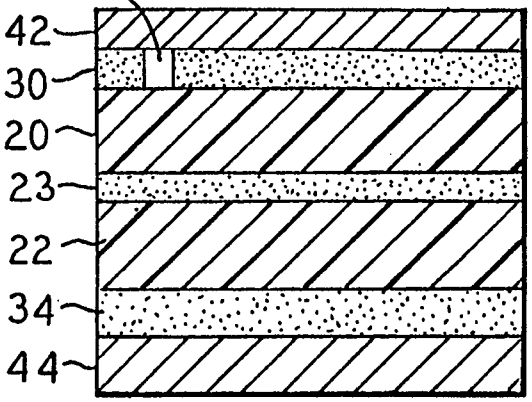
FIG. 6 is a side view of the layers of a MAGIC FILM® product used in the process.

As best seen in FIG. 6, the first adhesive 30 is preferably pattern coated such that a strip 37 of the first film 20 is not coated with the first adhesive 30. The size of the strip is adjustable as desired but is preferably 3/16" (0.50 cm) to ¼" (0.64 cm). This uncoated strip 37 is the initial step in an alternate means for creating the tab 29. This uncoated strip 37 is preferably positioned proximate to but not at an edge of the first film 20, the edge corresponding to the side of the construction which will have the tab 29. However, other locations and even two or more such strips 37 are possible.

The custom designed MAGIC FILM® construction is preferably manufactured in a roll. The length of the roll is measured in a direction perpendicular to the plane of the paper of FIG. 3. The width is measured in the horizontal direction of FIG. 3 while the thickness is measured in the vertical direction.

Figure 4:
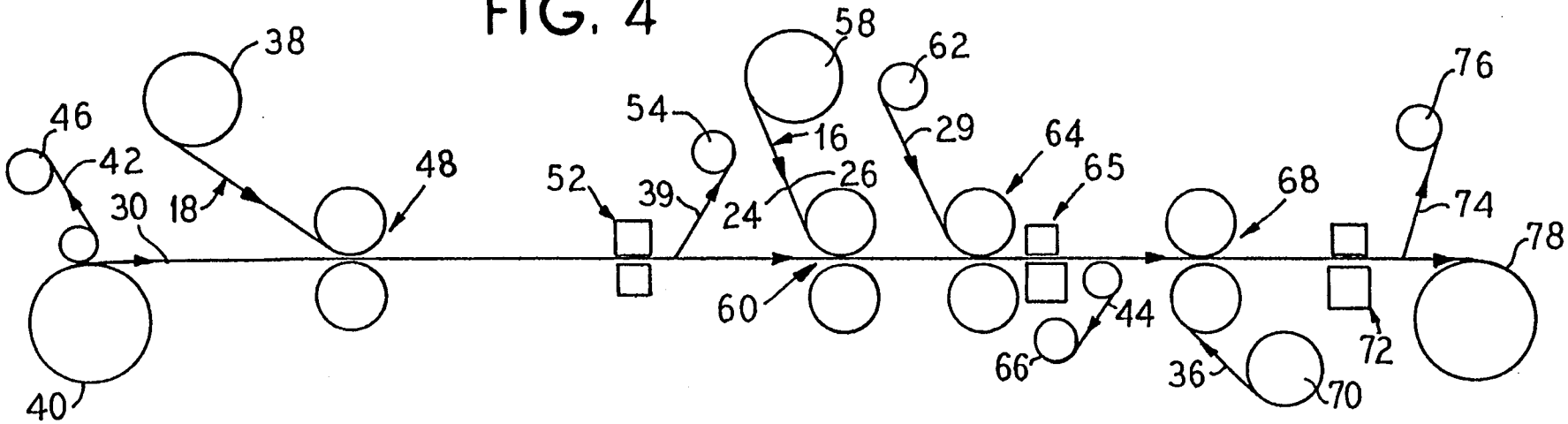
FIG. 4 is a side view of the preferred process used to manufacture a framed stencil apparatus.

The manufacturing process is preferably performed on a continuous machine best shown in FIG. 4. It will be understood by those skilled in the art that the process steps described below could be performed on individual machines instead of the preferred continuous process.

Figure 5:
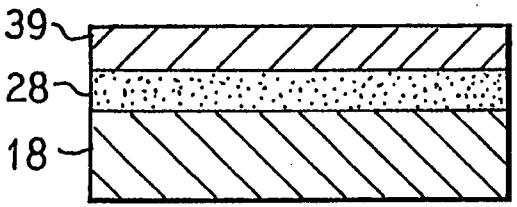
FIG. 5 is a side view of the layers of an offset paper used in the process.

Preferably a first roll 38 is mounted above the unwind end of the machine. FIG. 5 provides an illustration of the layers of the first roll 38 as it unwinds. The first roll 38 incorporates the frame 18 material which is preferably 60# or 80# offset paper, the frame stencil attachment means 28 which is preferably the B85 adhesive and a first roll release liner 39 which is preferably a 40# silicone liner. The first roll 38 is preferably purchased from the Brown-Bridge Division of Kimberly-Clark, Troy, Ohio.

A second roll 40 is mounted at the unwind end of the machine as shown. The second roll 40 is the MAGIC FILM® product discussed above. The MAGIC FILM® product as supplied includes the first film 20, the second film 22, the chemical bonding 23, the first adhesive layer 30 and the second adhesive layer 34. The first and second adhesive layers 30 and 34 are covered by a second roll first release liner 42 and a second roll second release liner 44 respectively, both preferably 40# silicone liners.

As an alternative embodiment, the first adhesive 30 and the second roll first release liner 42 could be situated on the first roll 38 instead of the second roll 40. The first adhesive 30 would be applied directly to the frame 18 of the second roll 40 with the second roll first release liner 42 covering the first adhesive 30. The first adhesive 30 can also be pattern coated in this embodiment.

As still another alternative embodiment, the layers of the second roll 40 could be inverted such that the second film 22, preferably MYLAR® polyester from DuPont, is adjacent the frame 18. With layering as described herein it is possible to use a thicker polyester second film 22 and completely eliminate the frame 18. The thicker second film 22 would act to provide the requisite stiffness. Alternatively, the first film 20 could be made of a stiffer material such as polyester.

On the other hand, if the frame 18 is completely eliminated without substituting a stiffer first film 20 or second film 22, an embodiment similar to a tape top stencil will be created. This embodiment would be suitable for those users who are not concerned with the need for a stiff framed stencil.

FIG. 4 illustrates the MAGIC FILM® product as it is unwound from the second roll 40. The second roll first release liner 42 is stripped from the second roll 40 and rewound onto a first waste roll 46. The stripping of the second roll first release liner 42 exposes the first adhesive 30. The exposed first adhesive 30 of the second roll 40 is laminated to the bottom of the first roll 38 (the frame 18) at a first laminating station 48. After this point, the nascent stencil apparatus 10 is layered as shown in FIG. 7.

As an alternative embodiment, the positions of first roll 38 and second roll 40 can be switched. The layers of each roll would be inverted from the embodiment illustrated here. As a consequence, a turnover station which inverts the layers could be incorporated at some stage of this process. In one alternative embodiment, the turnover station was positioned immediately after the first laminating station 48.

The process of laminating two rolls together as described herein is old in the art. In the preferred process, the adhesives employed are pressure-sensitives which do not require heat to adhere, merely pressure. Such lamination processes are well known and will not be further described herein.

Figure 7:
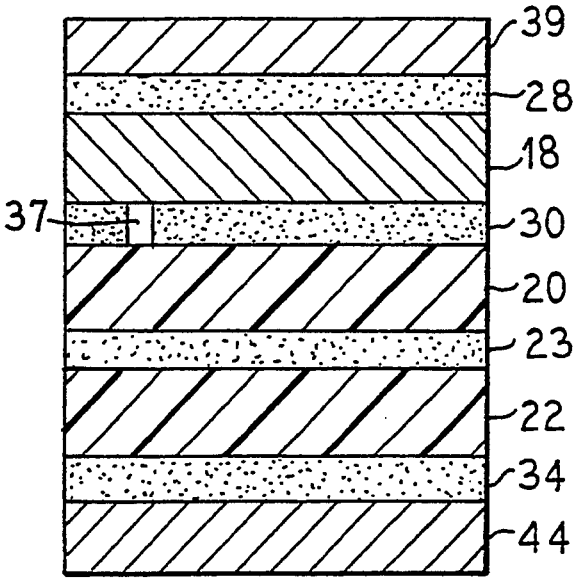
FIG. 7 is a side view of the layers present in an intermediate step of the process.
Figure 8:
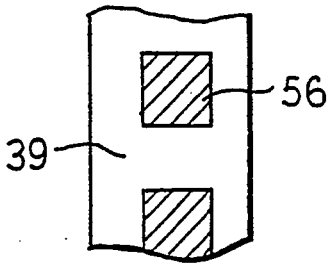
FIG. 8 is a top view of an intermediate step of the process.

The construction shown in FIG. 7 is fed into a first diecutting station 52. The first diecutting station 52 cuts the opening 17. The cut is made from the second roll second release liner 44 layer through all the layers except the first roll release liner 39. Immediately after the first diecutting station 52, the first roll release liner 39 is stripped and rewound onto a second waste roll 54. A waste center portion 56 which comprises the layers which occupied the now diecut opening 17 stays with the first roll release liner 39 as shown in FIG. 8.

The nascent frame stencil apparatus 10 will now have framed stencil attachment means 28 exposed after the stripping of the first roll release liner 39. In addition, a series of openings 17 will give the remaining roll material a ladder-like appearance.

A third roll 58 is mounted above the line as shown. The third roll 58 is the stencil material 16 which is now laminated to the exposed framed stencil attachment means 28 in a second laminating station 60. As shown, the bottom surface 24 which incorporates the carbon layer is face downward.

As an alternative embodiment, the framed stencil attachment means 28 can be pattern coated to leave an edge strip or edge strips of the frame 18 uncoated. If the stencil material 16 is then laminated to only the exposed adhesive, such uncoated edge strips can act as a tab 29. This embodiment requires the stencil material 16 to be narrower than the frame 18.

To make the alternate embodiment as best shown in FIG. 3, a fourth roll 62 can be positioned above the line as shown. The fourth roll 62 comprises the tab 29 used in this alternative embodiment. The fourth roll 62 comprises a narrow strip of either paper or film with adhesive which is laminated to the edge of the framed stencil in a third laminating station 64. As shown in FIG. 3, the tab 29 is positioned on the stencil apparatus 10 but extends over its edge to provide a mark to tell a user which side has the strip 37.

A third die cut station 65 is preferably positioned after the third lamination station 64 to impress indicia such as a customer's logo and address onto the present construction. Alternatively, the third die cut station 65 can be positioned just prior to rewinding the completed construction.

At this point, the second roll second release liner 44 has a ladder-like appearance due to the diecutting operation performed in the first diecutting station 52. After the third laminating station, preferably the second roll second release liner 44 is stripped and wound on a third waste roll 66 which exposes the second adhesive 34. Note that if making the embodiment which utilizes two U-shaped second film 22 portions as described previously, second roll second release liner 44 would be in two strips which would require separate removal.

The full width release liner 36, preferably 50#silicone release liner, is laminated at a fourth laminating station 68 to the exposed second adhesive 34. The release liner 36 is unwound second from a fifth roll 70.

As an alternative, the second roll second release liner 44 can be left on to perform the function of release liner 36 and fifth roll 70 is not needed. Due to the ladder-like appearances of the stencil apparatus 10 in this embodiment, greater care must be taken in its handling.

Figure 9:
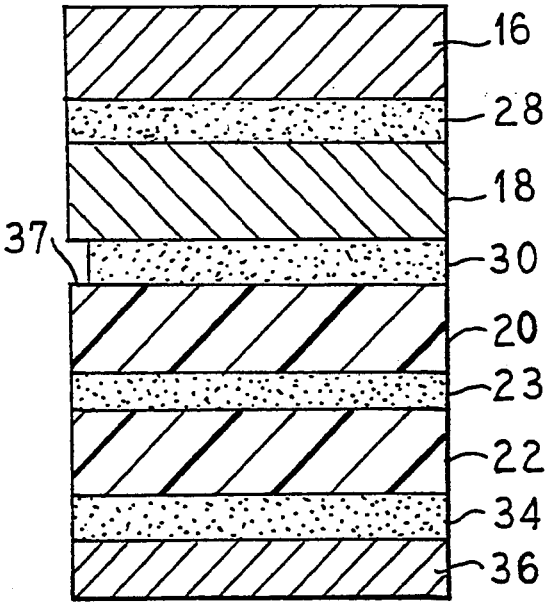
FIG. 9 is a side view of the layers present in an intermediate step of the process.

A second diecutting station 72 now receives the construction fed from the fourth laminating station 68. The second diecutting station 72 cuts the outer edges of the stencil apparatus 10 through all the layers except the release liner 36. The cut intersects the edge of strip 37 which is nearest the edge of the stencil apparatus 10. An undercut portion of the frame 18 results which provides a release point for a user as best seen in FIG. 9.

Figure 10:
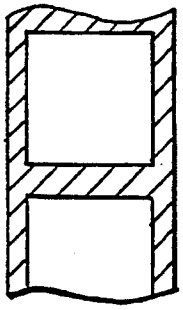
FIG. 10 is a top view of an intermediate step in the process.
Figure 11:
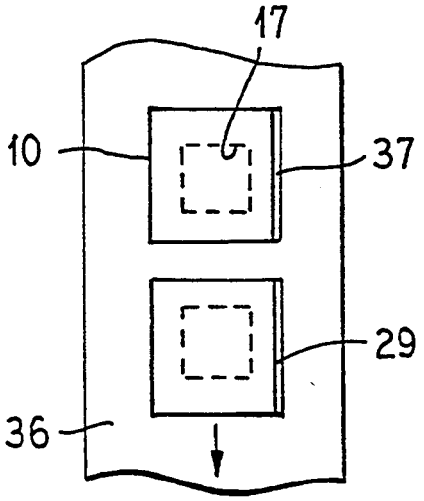
FIG. 11 is a top view of the framed stencil apparatus as completed.

Immediately after the second diecutting station 72, all portions 74 of the layers outside the outer edges of the stencil apparatus 10 are stripped from release liner 36. The stripped portions 74 are wound onto a fourth waste roll 76 for disposal. These stripped portions 74 have a ladder-like appearance as best seen in FIG. 10. The finished product is wound onto rewind roll 78. As shown in FIG. 11, the stencil apparatus 10 are wound up on the release liner 36 in a roll format. This particular embodiment is particularly useful with label affixing equipment.

It should be noted that the above description of the process of manufacturing framed stencils in a line demonstrates the major steps in that process. Items such as idler rolls, edge guides, tension controls and brakes are not explicitly illustrated herein. Such matters are matters of engineering choice well known to those skilled in the art and are not further described herein.

In the present device, the stencil apparatus 10 is stripped away from the release liner 36 thereby exposing the second adhesive 34. The stencil apparatus 10 can be placed manually on the form 14 with the second adhesive 34 contacting and adhering to the form 14. However, the preferred method of applying the stencil apparatus is by use of a label affixing device.

Figure 12:
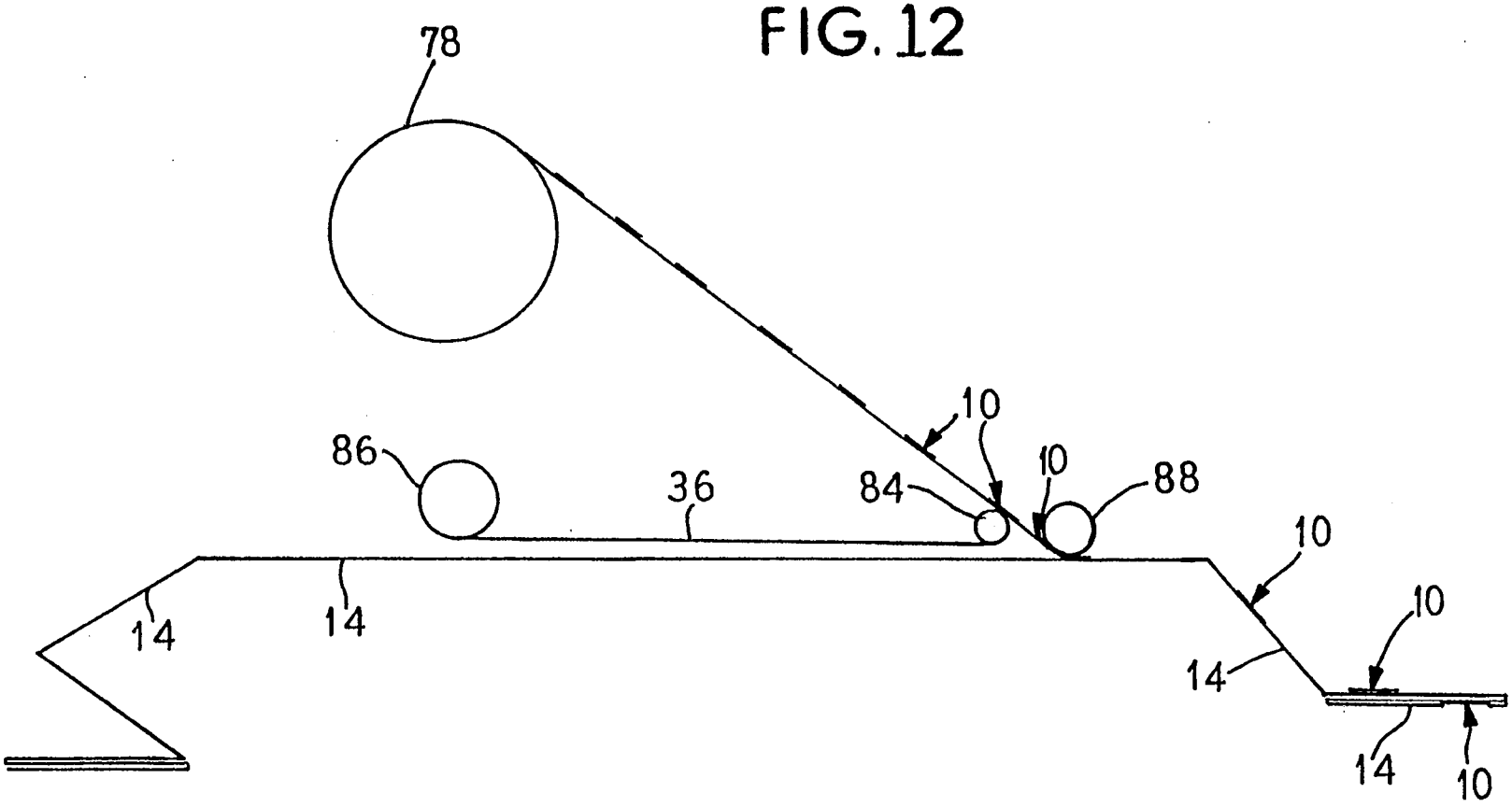

As such, the present invention eliminates the glue step and its glue application machinery in their entirety. FIG. 12 shows a side view of a label affixing machine 82 utilized to apply the stencil apparatus 10 to the form 14.

Rewind roll 78 is taken to the label affixing machine 82 and is mounted as shown. The product is unwound and the release liner 36 is removed at the stripper 84. The release liner 36 is rewound at a fifth waste roll 86 and later disposed of or recycled as scrap.

Immediately after the stripper bar 84, the individual framed stencil apparatuses 10 are applied to the forms 14 at an applicator roll 88. In general, the forms 14 are in the form of a stack of continuous-feed forms 14. Of course, individual forms 14 could be fed in by an appropriate sheet-feeding mechanism if desired.

The indicia can then be impressed upon the stencil material 16 and transferred to the form 14. Since the adhesives extend to the edge of the frame 18, there will be no uncoated edges to cause jamming while traversing the printer. The stencil apparatus 10 is separated by utilizing tab 29 which leaves the cleanly releasable second film 22 exposed on the form 14. Since second film 22 is tack free and dry to the touch, a multiplicity of the forms 14 may be stacked or filed with no danger of the forms 14 sticking together. No carbon or glue residue will remain to smear thus leaving the form 14 clear and readable.

The frame 18 and stencil material 16 are taken to see another location wherein the impressed indicia can be reproduced as desired. Since the first film 20 is tack-free and dry to the touch, the frame 18 and the stencil material 16 will not adhere to the second surface when transferring the improved indicia.

The foregoing description and drawings merely explain and illustrate the invention and the invention is not limited thereto except insofar as the amended claims are so limited, as those skilled in the art who have the disclosure before them will be able to make modifications and variations therein without departing from the scope of the invention. For example, the illustrated positions of the frame 18 and the stencil material 16 could be reversed.

What is claimed is:

1. A stencil apparatus which can be releasably secured to an upper surface of a substrate, the stencil apparatus comprising:

stencil material having a top surface and a bottom surface, the stencil material comprising a deformable means for accepting impression of indicia thereon and enabling the reproduction of the impressed indicia on an other surface when a fluid medium is applied on the top surface such that the fluid medium can pass through the impressed indicia to reproduce the impressed indicia on the other surface; and b) substrate attachment means for releasably securing the bottom surface of the stencil material on the substrate with the bottom surface of the stencil material in the desired location on the substrate, the substrate attachment means being cooperatively mounted on the bottom surface of the stencil material and comprised of a tack-free material characterized by cleanly separating the stencil material from the substrate, such that each of the stencil material and the substrate are tack free after separating, said substrate attachment means including a first film affixed to the bottom surface of the stencil material by first adhesive means, the first film covering a portion of the stencil material, and a second film releasably secured to the first film, the second film being sufficient to substantially cover the first film, the second film being secured to the substrate by second adhesive means, a release liner being stripably mounted to the second adhesive means, the release liner being stripped from the second adhesive means prior to securing the second film to the substrate with the second adhesive means, the first film cleanly separating from the second film and the first film and the second film are tack free after such release.

2. The apparatus of claim 1 further comprising means for transferring the impressed indicia to the substrate.

3. The apparatus of claim 2 wherein the means for transferring the impressed indicia to the substrate comprises a carbon layer mounted on the bottom surface of the stencil material to enable the simultaneous imprinting of the impressed indicia on the stencil material and on the substrate.

4. The apparatus of claim 1 wherein the stencil assembly is substantially rectangular in shape with the frame being continuous about the periphery of the apparatus.

5. The apparatus of claim 1 further comprising a substantially continuous frame defining an opening, the opening being sufficient to permit the stencil material to contact the upper surface of the substrate in an unobstructed manner for transfer of the impressed indicia upon the substrate, the frame being attached to a marginal portion of the periphery of the stencil material by framed stencil attachment means.

6. The apparatus of claim 5 wherein the frame comprises the first film, the first film being a polyester film of greater than one mil thickness.

7. The apparatus of claim 1 wherein the first film and the second film are plastic films.

8. The apparatus of in claim 7 wherein the second film is a polyester and the first film is a cast acrylic.

9. The apparatus of claim 1 wherein the first film is releasably secured to the second film by chemical bonding.

10. The apparatus of claim 1 wherein the first film and the second film are paper.

11. The apparatus of claim 1 including a plurality of stencil apparatuses mounted on the release liner.

12. The apparatus according claim 1 wherein the first and second adhesive means are acrylic adhesive.

13. The apparatus of claim 1 further comprising a tab, the tab being large enough to allow the tab to be used to facilitate the release of the frame from the substrate.

14. A framed stencil apparatus which can be releasably secured to an upper surface of a substrate, the framed stencil apparatus comprising:

a) means for accepting the impression of indicia and transferring the impression to the substrate;

b) a stencil material having a top surface and a bottom surface, the stencil material being deformable to accept the impressed indicia and to enable the reproduction of the impressed on another surface by the application of a fluid medium so that the fluid medium can pass through the impressed indicia to reproduce the impressed indicia on the other surface;

c) a substantially continuous frame having a top surface and a bottom surface and defining an opening, the opening being sufficient to permit the bottom surface of the stencil material to contact the upper surface of the substrate in an unobstructed manner for transfer of the impressed indicia directly upon the substrate, the frame being attached to a marginal portion of the stencil material by framed stencil attachment means;

d) a first film affixed to the bottom surface of the frame by first adhesive means, the first film covering at least a portion of the frame and not overlapping the opening;

e) a second film releasably secured to the first film, the second film being sufficient to substantially cover the first film, the second film being secured to the substrate by second adhesive means, the first film cleanly releasing from the second film and the first film and the second film are tack free after such release;

f) a release liner stripably mounted to the second adhesive means, the release liner being stripped from the second adhesive means prior to securing the second film to the substrate; and g) a tab associated with the first film, the tab being large enough to allow the tab to be used to facilitate the release of the frame from the substrate.

15. The apparatus of claim 14 wherein the first film is sufficient to substantially cover the frame.

16. The apparatus of claim 15 wherein the first film includes a strip extending beyond the periphery of the frame, the tab being mounted to the strip.

17. The apparatus of claim 14 wherein the first film is attached to the second film by chemical bonding.

18. The apparatus of in claim 14 wherein the first adhesive means and the second adhesive means are acrylic adhesives.

19. The apparatus of claim 14 wherein the means for transferring the impressed indicia to the substrate comprises a carbon mounted on the bottom surface of the stencil material to enable the simultaneous imprinting of the impressed indicia on the stencil material and on the substrate.

20. The apparatus of claim 14 wherein the framed stencil assembly is substantially rectangular in shape with the frame being continuous about the periphery of the apparatus.

21. The apparatus of claim 14, wherein the frame stencil attachment means is an adhesive.

22. The apparatus of claim 14 wherein the first film and the second film comprise a plastic material.

23. The apparatus of claim 14 wherein the first film is releasably attached to the second film by an adhesive.

24. The apparatus of claim 14 wherein the tab comprises a portion of the frame.

25. A form apparatus which includes a framed stencil releasably secured to the upper surface of the form, the form apparatus comprising:

a) a substrate;

b) a stencil material having a top surface and a bottom surface, the stencil material comprising a deformable means for accepting impression of indicia thereon and enabling the reproduction of the impressed indicia on an other surface when a fluid medium is applied on the top surface such that the fluid medium can pass through the impressed indicia to reproduce the impressed indicia on the other surface;

c) a substantially continuous frame having a top surface and a bottom surface, the frame defining an opening sufficient to permit the bottom surface of the stencil material to contact the upper surface of the substrate to provide a means for unobstructed transfer of the impressed indicia upon the substrate therethrough, the frame being attached to a marginal portion of the bottom surface of the stencil material by framed stencil attachment means; and d) substrate attachment means for releasably securing the frame on the substrate with the bottom surface of the stencil material in the desired location on the substrate, the substrate attachment means being cooperatively mounted on the bottom surface of the stencil material and comprised of a tack-free material characterized by cleanly releasing the frame from the substrate and the substrate and the frame are tack free after such release, said substrate attachment means including a first film affixed to the bottom surface of the frame by first adhesive means, the first film covering a portion of the frame and not overlapping the opening, and a second film releasably secured to the first film, the second film being sufficient to substantially cover the first film, the second film being secured to the substrate by second adhesive means, the first film clearly releasing from the second film whereby no objectionable residue remains on the first film and the second film after such release.

26. The apparatus according claim 25 wherein the second acrylic adhesive means is an adhesive.

27. The apparatus of claim 25 further comprising a tab, the tab being large enough to allow the tab to be used to facilitate the release of the frame from the substrate.

28. The apparatus of claim 25 further comprising means for and transferring the impressed indicia to the substrate.

29. The apparatus of claim 25 wherein the means for enabling the reproduction of the impressed indicia on the substrate comprises a carbon mounted on the bottom surface of the stencil material to enable the simultaneous imprinting of the impressed indicia on the stencil material and on the substrate.

30. The apparatus of claim 25 wherein the framed stencil assembly is substantially rectangular in shape with the frame being continuous about the periphery of the apparatus.

31. The apparatus of claim 25, wherein the framed stencil attachment means is a pressure-sensitive adhesive.

32. The apparatus of claim 25 wherein the substrate attachment means is an adhesive.

33. The apparatus of claim 25 wherein the first film is attached to the bottom surface of the frame by an adhesive.

34. The apparatus of claim 25 wherein the first film and the second film comprise a plastic material.

35. The apparatus of in claim 34 wherein the second film comprises a polyester material.

36. The apparatus of claim 34 wherein the first film comprises a cast acrylic.

37. The apparatus of claim 25 wherein the first film is releasably attached to the second film by chemical bonding.

38. The apparatus of claim 25 wherein the first film is releasably attached to the second film by an adhesive.

Kindly amend claim 42 as follows:

* * * * *